US005404874A

United States Patent [19]

Meier

[11] Patent Number: 5,404,874

[45] Date of Patent: Apr. 11, 1995

[54] DEVICE FOR CONNECTING A FAN TO A FACE MASK FILTER

[75] Inventor: Peter Meier, Lindau, Switzerland

[73] Assignee: Micronel AG, Switzerland

[21] Appl. No.: 27,372

[22] Filed: Mar. 8, 1993

[30] Foreign Application Priority Data

Mar. 19, 1992 [CH] Switzerland ..... 882/92

[51] Int. Cl.[6] ..... A62B 18/08; A62B 19/00; A62B 7/10; A62B 23/02

[52] U.S. Cl. ..... 128/206.17; 128/205.12; 128/205.25; 128/205.29; 128/206.12

[58] Field of Search ..... 128/200.24, 204.18, 128/205.25, 205.29, 206.12, 206.17, 206.21, 206.28, 205.12; 55/271, 273

[56] References Cited

U.S. PATENT DOCUMENTS

| | | | |
|---|---|---|---|
| 2,012,441 | 8/1935 | Willson | 128/205.25 |
| 3,629,868 | 12/1971 | Greenlee | 128/205.25 |
| 4,402,716 | 9/1983 | Chiaramonte | 55/471 X |
| 5,265,595 | 11/1993 | Rudolph | 128/204.18 |

FOREIGN PATENT DOCUMENTS

| | | | |
|---|---|---|---|
| 917117 | 12/1946 | France | 55/471 |
| 3623269 | 1/1988 | Germany . | |
| 2102104 | 4/1990 | Japan | 128/204.18 |
| 560877 | 4/1944 | United Kingdom | 128/201.25 |
| 2173705 | 10/1986 | United Kingdom | 128/206.12 |
| 2221164 | 1/1990 | United Kingdom | 128/206.17 |
| 2222777 | 3/1990 | United Kingdom | 128/205.29 |
| 620266 | 7/1978 | U.S.S.R. | 128/205.25 |

*Primary Examiner*—Kimberly L. Asher
*Attorney, Agent, or Firm*—Webb Ziesenheim Bruening Logsdon Orkin & Hanson

[57] ABSTRACT

A device for connecting a fan to the inlet of a face mask filter including an adapter having resilient arms to fasten it to the filter and an air duct extends from the fan outlet to the filter inlet. The adapter has an internal seal to connect the outlet end of the air duct to the inlet of the filter. A housing for the fan is partly molded directly on the adapter adjacent to the inlet end of the air duct. The air duct is short and straight and has low flow resistance.

26 Claims, 3 Drawing Sheets

DEVICE FOR CONNECTING A FAN TO A FACE MASK FILTER

BACKGROUND OF THE INVENTION

1. Field of the Invention

This invention relates to a device for connecting a fan to the inlet of a face mask filter to generate an overpressure (i.e., a pressure in excess of atmospheric pressure) in the face mask filter and in a face mask attached to the filter. The device includes an adapter having means for fastening it to the face mask filter and an air duct leading from the fan to the inlet of the face mask filter.

2. Description of the Prior Art.

A connecting device of this type is disclosed in United Kingdom patent GB-A-560,877. That device has a fan with an electric motor which sucks in air through openings in a housing and transports it through a filter to a face mask. An overpressure is created by the fan in the face mask which assists the breathing of the person wearing the face mask. However, this device is not suitable for the commercial canister filters which are generally used.

A similar device is disclosed in German patent DE-A-3,623,269. The device includes an adapter which is made of a flexible rubber and has a tubular extension into which a canister filter can be inserted. A particular disadvantage of the device is that it comparatively difficult to insert the fan into the adapter, when the adapter has elastically expanded, and to remove it. Periodic cleaning of the fan which is necessary with such a device is therefore very complex, time-consuming and expensive. The comparatively long and large ventilation duct between the inlet of the filter and the outlet of the fan is an additional disadvantage.

SUMMARY OF THE INVENTION

The object of the present invention is to create a device of the type described above, which is suitable for connection to conventional canister filters and which has a significantly shorter air duct between the inlet of the face mask filter and the fan.

This object is achieved according to the present invention by a device which includes an adapter having fastening means for connecting the device to a canister filter and internal sealing means, separate from the fastening means, to connect the outlet end of the air duct to the inlet of the face mask filter. The adapter is molded onto a fan housing in the vicinity of the inlet end of the air duct. Since the sealing means are independent of the fastening means, they can be installed directly on the inlet of the face mask filter. Additionally, since the adapter is molded onto the fan housing in the vicinity of the inlet end of the air duct, the air duct is very short, e.g. less than 2 cm in length, and is straight. Furthermore, since the fastening means does not perform any sealing function, these means can be designed as retaining arms. This makes it possible to fasten the adapter to the face mask filter very simply, and saves a great deal of material in the manufacturing process. Additionally, the sealing means can be replaced very easily and the weight of the device is low which is essential to provide wearing comfort.

Additional advantages of the invention are disclosed in the accompanying description and drawings wherein like reference characters refer to like parts.

DESCRIPTION OF THE PREFERRED EMBODIMENT

Figure 1:
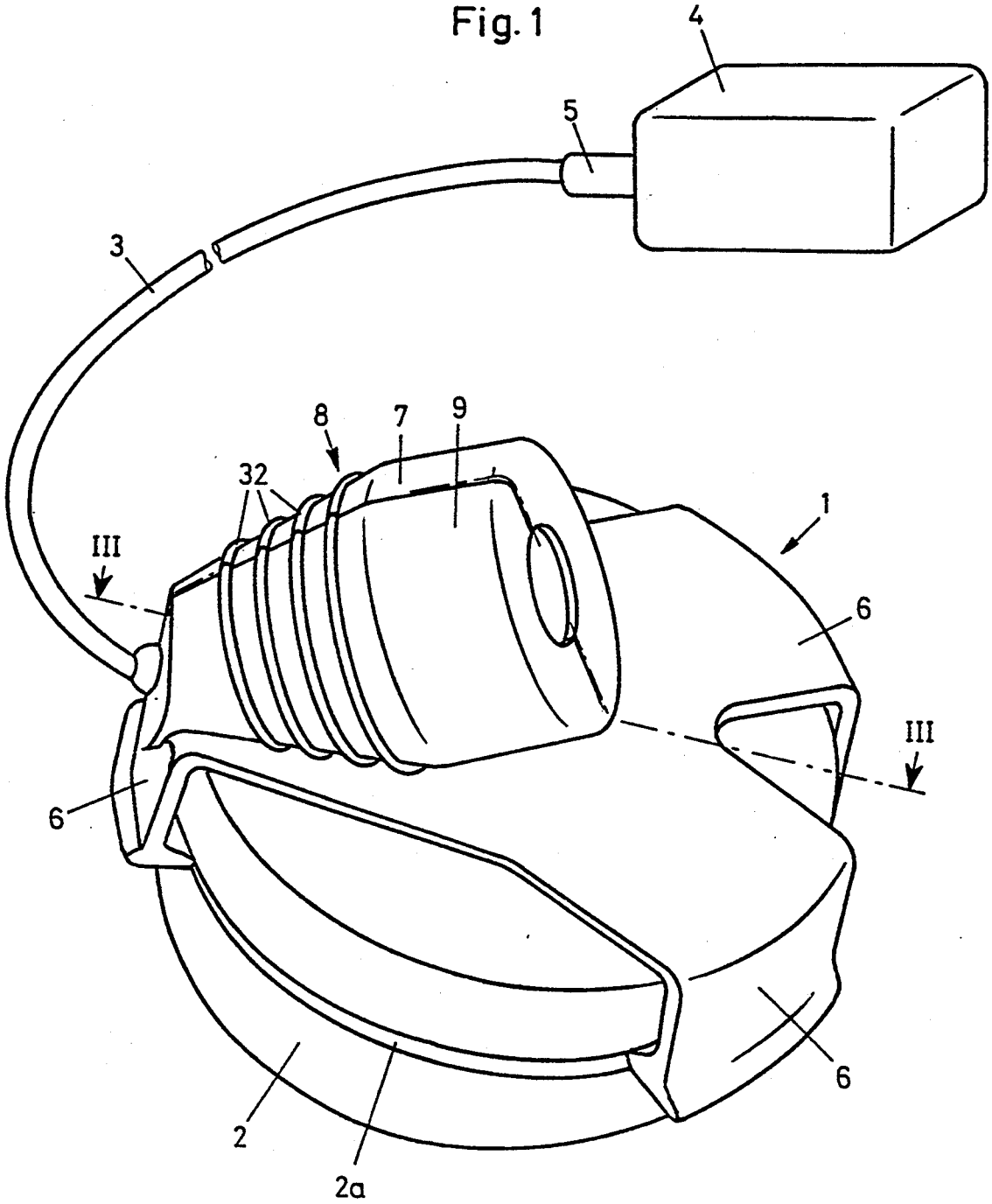
FIG. 1 is a perspective of a device according to the invention connected to a canister filter.

As shown in the drawings, the device includes an adapter 1 onto which one half 7 of a fan housing 8 is externally molded. Three retaining arms 6 are molded onto the adapter 1 in a radial configuration. Each arm 6 has an extension **6*a* located on the outer end. When the device is mounted on a canister filter 2 as shown in FIG. 1, the extensions 6*a* engage in an annular groove 2*a* in the canister filter. The adapter 1 is made of a suitable plastic material and may be manufactured using an injection molding process. Thus arms 6 are sufficiently resilient for firm engagement with annular groove 2*a* on the periphery of canister filter 2**.

Figure 3:
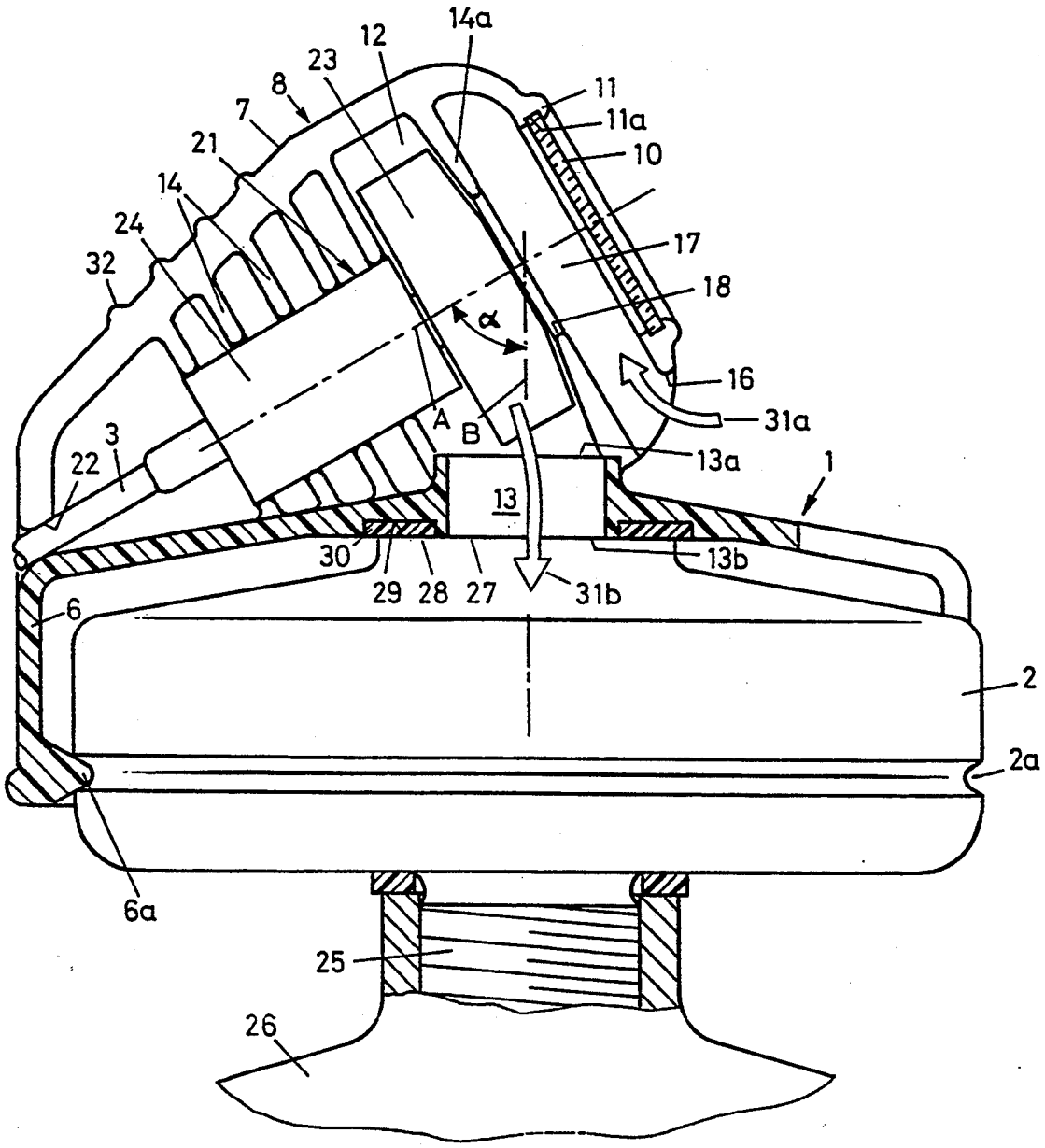
FIG. 3 is a section on line III—III of FIG. 1.

The adapter has a centrally located circular comparatively short duct 13. As shown in FIG. 3, the upper inlet end **13*a* of duct 13 is connected to a chamber 12 of fan housing 8 and a fan wheel 23 of a radial fan 21 is located in the chamber. The included angle $\alpha$ between the axis of rotation A of fan wheel 23 and the longitudinal axis B of canister filter 2 is less than 90°. It is also apparent that the longitudinal axis of cylindrical duct 13 coincides with the longitudinal axis B of the canister filter. An additional chamber 17 is located in housing 8 in front of chamber 12. Chambers 8 and 12 are connected by an opening 18 and a window 10 is located in housing 8 for observation of fan wheel 23 so that it can be determined whether the fan wheel is rotating. The chamber 17 is connected to the atmosphere by a suction opening 16**.

The fan 21 includes an electric motor 24 which is connected by an electric cable 3 and a plug 5 to a battery pack 4 which is shown schematically in FIG. 1. The fan 21 is activated by inserting the plug 5 into the battery pack or an on and off switch may be located in cable 3.

As shown in FIG. 3, the lower outlet end **13*b* of air duct 13 is connected to the inlet 27 of canister filter 2. A gasket 30 is inserted in a ring-shaped recess 29 on the inside of adapter 1 so that the gasket is in sealing engagement with the mouth 28 of canister filter inlet 27. A threaded connector 25 is formed on canister filter 2 opposite inlet 27 for connecting the canister filter to the face mask 26**.

When fan 21 is operating, atmospheric air is sucked into chamber 17 through opening 16 in the direction of the arrow **31*a*. As shown in FIG. 3, opening 16 is partially covered on the side by housing 8 and adapter 1 so that the opening is protected against contamination. The air which is sucked in through opening 16 travels from chamber 17 through opening 18 into chamber 12, and from there, as a result of the action of fan 21, directly into duct 13, in the direction of the arrow 31*b*. The air travels from duct 13 into the inside of canister filter 2 and flows through it and through threaded connector 25 into face mask 26. The air sucked through opening 16 therefore travels a relatively short distance and under overpressure from duct 13 into canister filter 2 wherein the air is filtered. The filtered air finally arrives inside face mask 26** where, under overpressure, it is available for breathing by the wearer of the mask.

The face mask can also be used when the fan is stopped or when the fan has been removed. Under such circumstances, the breathing assist feature is not present and the user must overcome the flow resistance of canister filter 2 by his own breathing, which can require a great deal of effort.

Figure 2:
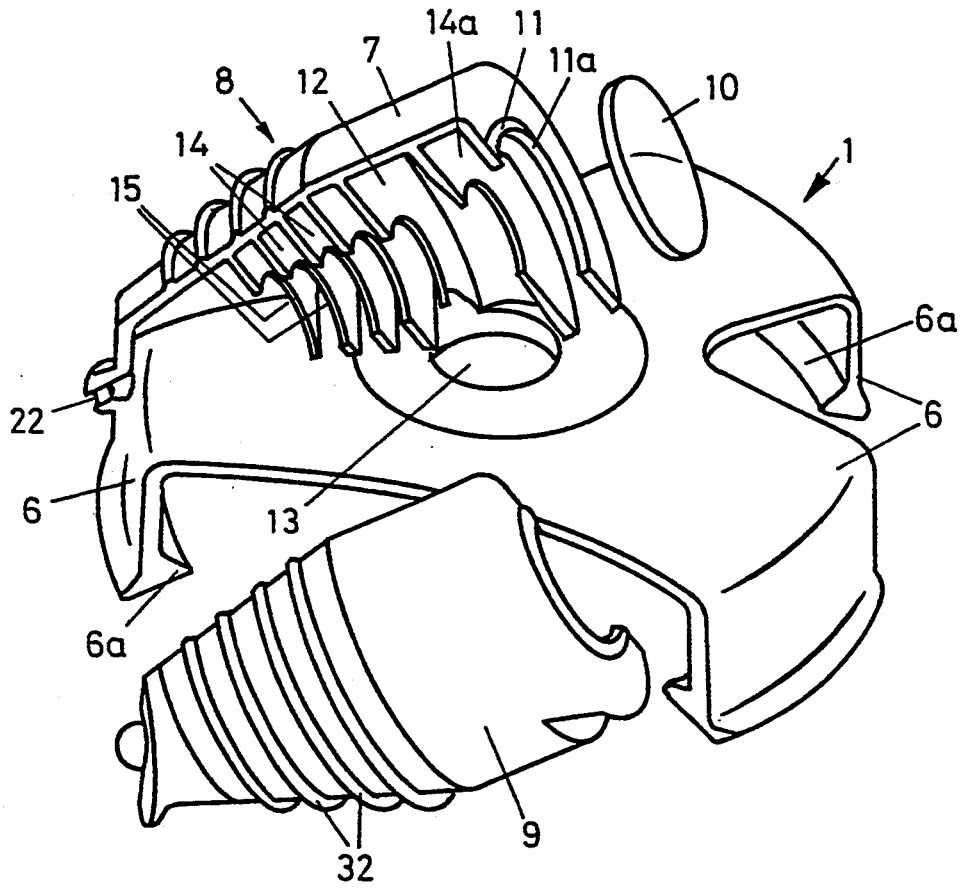
FIG. 2 is a perspective wherein parts are exploded.

As shown in FIG. 2, housing 8 of fan 21 consists of a half 7 which is molded onto adapter 1 and a separate half 9 which is connected to half 7. The halves 7 and 9 have parallel radial protrusions 14 molded on the inside surfaces which form spaced circular openings 15 to hold fan motor 24. A radial protrusion 14*a* which is located between the adjacent radial protrusion 14 and a lip 11 forms a wall of chamber 12 and defines opening 18. Lip 11 is formed on halves 7 and 9 and a groove 11*a* is formed in lip 11 to receive the edge of window 10 as shown in FIG. 3.

Assembly of the device is very simple. When half 9 is removed, window 10 and fan 21 are inserted into half 7. Half 9 is then replaced and fastened to half 7 by screws or other fastening means. The cable 3 extends outwardly through an opening 22 at the end of housing 8 opposite window 10. Half 9 is removed to access the inside of housing 8 for cleaning or inspection and/or replacement of fan 21. The fan 21 consists only of motor 24, fan wheel 23 and cable 3 which are supported by halves 7 and 9 of housing 8 so that a separate housing is not necessary. This results in a savings of both weight and material. The exterior surface of housing 8 forms a handle by which the adapter 1 is held when it is attached to and removed from the canister filter.

As shown in FIG. 1, in particular, a very compact construction is achieved as a result of the frusto-conical configuration of housing 8 and as a result of the inclined orientation of canister axis A. Circular ribs 32 are molded on the outer surfaces of halves 7 and 9 of housing 8 to increase the ease of handling the adapter.

Having described a presently preferred embodiment of the invention, it is to be understood that it may otherwise be embodied within the scope of the appended claims.

I claim:

1. A device adapted to connect a fan to an inlet of a filter for use with a face mask to generate an overpressure in the filter and in a face mask attached to the outlet side of the filter, said device including an adapter having means for fastening said device to an outer peripheral surface of a filter comprising resilient retaining arms on said adapter extending radially from an air duct having a longitudinal axis and an inlet end and an outlet end or connecting a fan to the inlet of the filter, said adapter having a sealing means for connecting said outlet end of said air duct to an inlet of a filter, and a housing adapted to receive and position a fan with said adapter in flow communication with said inlet end of said air duct.

2. A device as set forth in claim 1, including three radial resilient retaining arms and said housing for a fan is attached adjacent to the outside of one of said retaining arms.

3. A device as set forth in claim 2, wherein said housing for a fan comprises two halves, whereby one of said halves is molded integrally with said adapter and the other of said halves is a removable cover.

4. A device as set forth in claim 3, wherein said housing has an end having a lip, a groove formed in said lip and a window in said groove, whereby said fan can be observed through said window.

5. A device as set forth in claim 4, and a fan mounted in said housing on an axis of rotation which forms an acute included angle with the longitudinal axis of said air duct.

6. A device as set forth in claim 2, wherein said housing has an end having a lip, a groove formed in said lip and a window in said groove, whereby said fan can be observed through said window.

7. A device as set forth in claim 6, and a fan mounted in said housing on an axis of rotation which forms an acute included angle with the longitudinal axis of said air duct.

8. A device as set forth in claim 2, and an fan mounted in said housing on an axis of rotation which forms an acute included angle with the longitudinal axis of said air duct.

9. A device as set forth in claim 3, and a fan mounted in said housing on an axis of rotation which forms an acute included angle with the longitudinal axis of said air duct.

10. A device as set forth in claim 1, wherein said housing for a fan comprises two halves, whereby one of said halves is molded integrally with said adapter and the other of said halves is a removable cover.

11. A device as set forth in claim 10, wherein said housing has an end having a lip, a groove formed in said lip and a window in said groove, whereby said fan can be observed through said window.

12. A device as set forth in claim 11, and a fan mounted in said housing on an axis of rotation which forms an acute included angle with the longitudinal axis of said air duct.

13. A device as set forth in claim 10, and a fan mounted in said housing on an axis of rotation which forms an acute included angled with the longitudinal axis of said air duct.

14. A device as set forth in claim 1, wherein said housing has an end having a lip, a groove formed in said lip and a window in said groove, whereby said fan can be observed through said window.

15. A device as set forth in claim 14, and a fan mounted in said housing on an axis of rotation which forms an acute included angle with the longitudinal axis of said air duct.

16. A device as set forth in claim 1, and an fan mounted in said housing on an axis of rotation which forms an acute included angle with the longitudinal axis of said air duct.

17. A device as set forth in claim 16, wherein said acute included angle is between 90° and 45°.

18. A device as set forth in claim 1, wherein said air duct is short, straight and substantially cylindrical in cross section.

19. An assembly comprising a face mask, a fan and a filter having an inlet side with an inlet and an outlet side with an outlet, said face mask attached to said outlet of said filter, said filter positioned between said face mask and said fan and a device for connecting said fan to said inlet of said filter to generate an overpressure in said filter and in said face mask, said device including an adapter having means for fastening said fan to the outside of said filter and means forming an air duct having an inlet and an outlet end for connecting said fan to said inlet of said filter, said means for fastening said device to the outside of said filter comprising a plurality of resilient retaining arms on said adapter extending radially outwardly from said means forming an air duct, said retaining arms engaging an outer periphery of said filter, said adapter having sealing means between said outlet end of said air duct and said inlet end of said filter, a housing for said fan attached to said adapter and in flow communication with said inlet end of said air duct.

20. An assembly as set forth in claim 19, including three radial resilient retaining arms and wherein said housing for said fan is located adjacent to the outer surface of one of said retaining arms.

21. An assembly as set forth in claim 20, wherein said housing for said fan comprises two separable halves, one of said halves being molded integrally with said adapter and the other of said halves being a removable cover member.

22. An assembly as set forth in claim 21, wherein said housing for said fan has an end having a lip formed thereon, a groove formed in said lip and a window supported in said groove, whereby said fan can be observed through said window.

23. As assembly as set forth in claim 20, wherein said housing for said fan has an end having a lip formed thereon, a groove formed in said lip and a window supported in said groove, whereby said fan can be observed through said window.

24. An assembly as set forth in claim 19, wherein said housing for said fan comprises two separable halves, one of said halves being molded integrally with said adapter and the other of said halves being a removable cover member.

25. An assembly as set forth in claim 24, wherein said housing for said fan has an end having a lip formed thereon, a groove formed in said lip and a window supported in said groove, whereby said fan can be observed through said window.

26. An assembly as set forth in claim 19, wherein said housing for said fan has an end having a lip formed thereon, a groove formed in said lip and a window supported in said groove, whereby said fan can be observed through said window.

* * * * *

UNITED STATES PATENT AND TRADEMARK OFFICE

CERTIFICATE OF CORRECTION

PATENT NO. : 5,404,874
DATED : April 11, 1995
INVENTOR(S) : Peter Meier

It is certified that error appears in the above-indentified patent and that said Letters Patent is hereby corrected as shown below:

Column 1 Line 29 after "it" insert --is--.

Claim 1 Line 53 Column 3 "or connecting" should read --for connecting--.

Claim 8 Line 15 Column 4 "an fan" should read --a fan--.

Claim 13 Line 37 Column 4 "angled" should read --angle--.

Claim 16 Line 47 Column 4 "an fan" should read --a fan--.

Signed and Sealed this

Twenty-second Day of August, 1995

Bruce Lehman

*Attest:*

BRUCE LEHMAN

*Attesting Officer*

*Commissioner of Patents and Trademarks*